US011645985B2

(12) United States Patent
Jeong et al.

(10) Patent No.: US 11,645,985 B2
(45) Date of Patent: May 9, 2023

(54) DISPLAY APPARATUS INCLUDING A LUMINANCE COMPENSATING PART AND METHOD OF DRIVING THE SAME

(71) Applicant: SAMSUNG DISPLAY CO., LTD., Yongin-si (KR)

(72) Inventors: Hyun-Seok Jeong, Suwon-si (KR); Yeon-Sung Kim, Suwon-si (KR); Hyoung-Wook Kim, Hwaseong-si (KR); Choongseob Oh, Yongin-si (KR); Okyi Lee, Seoul (KR); JinHo Cho, Cheonan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 110 days.

(21) Appl. No.: 16/191,971

(22) Filed: Nov. 15, 2018

(65) Prior Publication Data

US 2019/0228722 A1 Jul. 25, 2019

(30) Foreign Application Priority Data

Jan. 22, 2018 (KR) ..... 10-2018-0007806

(51) Int. Cl.
*G09G 3/34* (2006.01)
*G09G 3/36* (2006.01)

(52) U.S. Cl.
CPC ... *G09G 3/3426* (2013.01); *G09G 2320/0233* (2013.01); *G09G 2330/021* (2013.01); *G09G 2360/16* (2013.01)

(58) Field of Classification Search
CPC .. G09G 5/00; G09G 5/10; G09G 5/18; G09G 3/20; G09G 3/34; G09G 3/36; G09G 3/3426; G09G 2320/0233; G09G 2330/021; G09G 2360/16; G02F 1/13; G02F 1/1343; G02F 1/1335; G02F 27/22
See application file for complete search history.

(56) References Cited

U.S. PATENT DOCUMENTS

| | | | | |
|---|---|---|---|---|
| 8,890,793 | B2 | 11/2014 | Wei et al. | |
| 2008/0186272 | A1 | 8/2008 | Huang et al. | |
| 2008/0239191 | A1* | 10/2008 | Kasuga | G02F 1/1362 349/54 |
| 2008/0284721 | A1* | 11/2008 | Hasegawa | G09G 3/3406 345/102 |
| 2008/0309611 | A1* | 12/2008 | Yang | G09G 3/3426 345/102 |

(Continued)

FOREIGN PATENT DOCUMENTS

| | | |
|---|---|---|
| KR | 1020100035027 | 4/2010 |
| KR | 1020120071801 | 7/2012 |

*Primary Examiner* — Chanh D Nguyen
*Assistant Examiner* — Nguyen H Truong
(74) *Attorney, Agent, or Firm* — F. Chau & Associates, LLC

(57) ABSTRACT

A display apparatus includes a display panel configured to display an image. The display panel includes a plurality of display areas. A display panel driver is configured to output a driving signal to the display panel. A backlight unit is configured to provide light to the display panel. A luminance compensating part is configured to generate a backlight compensating signal having different compensating values according to a distance between the display panel driver and the display areas of the display panel.

20 Claims, 11 Drawing Sheets

(56) References Cited

U.S. PATENT DOCUMENTS

| | | | | |
|---|---|---|---|---|
| 2011/0050738 | A1* | 3/2011 | Fujioka | G09G 3/36 345/690 |
| 2011/0249073 | A1* | 10/2011 | Cranfill | H04N 5/2258 348/14.02 |
| 2014/0327704 | A1* | 11/2014 | Wei | G09G 3/2022 345/690 |
| 2014/0327708 | A1* | 11/2014 | Yamakawa | G09G 3/36 345/102 |
| 2015/0194119 | A1* | 7/2015 | Ahn | G09G 3/3614 345/213 |
| 2016/0042701 | A1* | 2/2016 | Furumoto | G02F 1/1347 345/694 |
| 2016/0365051 | A1* | 12/2016 | Jung | G09G 3/3648 |
| 2017/0208661 | A1* | 7/2017 | Hussain | H05B 45/10 |
| 2018/0012565 | A1* | 1/2018 | Dunn | G09G 3/3406 |
| 2018/0061330 | A1* | 3/2018 | Jeon | G09G 3/3648 |
| 2018/0268753 | A1* | 9/2018 | Wang | G09G 3/2011 |

* cited by examiner

DISPLAY APPARATUS INCLUDING A LUMINANCE COMPENSATING PART AND METHOD OF DRIVING THE SAME

CROSS-REFERENCE TO RELATED APPLICATION

This application claims priority under 35 U.S.C. § 119 to Korean Patent Application No. 10-2018-0007806, filed on Jan. 22, 2018 in the Korean Intellectual Property Office KIPO, the disclosure of which is incorporated by reference herein in its entirety.

1. Technical Field

Exemplary embodiments of the present invention relate to a display apparatus and a method of driving the display apparatus. More particularly, exemplary embodiments of the present invention relate to a display apparatus including a luminance compensating part and a method of driving the same.

2. Discussion of Related Art

A display apparatus may include a display panel and a backlight assembly providing a light to be display panel. The display apparatus may include a display panel driver to drive the display panel and a backlight driver to drive the backlight assembly.

As a size of the display panel increases, difference of luminance between areas of the display panel according to a delay of a gate signal and a delay of a data voltage may be generated.

As an example, when the display apparatus is used as an outdoor billboard or an outdoor electric sign board, a plurality of display panels may be disposed adjacent to each other. The difference of the luminance between the areas of the display panel may be visible when the display panels are disposed adjacent to each other.

SUMMARY

An exemplary embodiment of the present invention provides a display apparatus compensating for a difference of luminance of a display panel according to a delay of a gate signal and a delay of a data voltage.

An exemplary embodiment of the present invention provides a method of driving the display apparatus.

In an exemplary embodiment of the present invention, a display apparatus includes a display panel configured to display an image. The display and includes a plurality of display areas. A display panel driver is configured to output a driving signal to the display panel. A backlight unit is configured to provide light to the display panel. A luminance compensating part is configured to generate a backlight compensating signal having different compensating values according to a distance between the display panel driver and the display areas of the display panel.

In an exemplary embodiment of the present invention, the luminance compensating part may receive an operation mode of the display panel. The operation mode may include a day mode and a night mode. The luminance compensating part may generate the backlight compensating signal when the operation mode is the night mode.

In an exemplary embodiment of the present invention, the luminance compensating part may generate the backlight compensating signal when a target luminance of the image displayed on the display panel is less than a threshold luminance.

In an exemplary embodiment of the present invention, the display apparatus may include a luminance sensor configured to sense a luminance of the image displayed on the display panel. The luminance compensating part may generate the backlight compensating signal when the sensed luminance is less than a threshold luminance.

In an exemplary embodiment of the present invention, the display panel driver may include a gate driver configured to output a gate signal to the display panel and a data driver configured to output a data voltage to the display panel. The display panel may include a central display area disposed in a central portion of the display panel and a corner display area relatively farthest from the gate driver and the data driver. The backlight unit may include a plurality of light source blocks corresponding to the display areas. The backlight unit may include a central light source block overlapped with the central display area and a corner light source block overlapped with the corner display area. The luminance compensating part may generate the different compensating values for the central light source block and the corner light source block.

In an exemplary embodiment of the present invention, when a luminance of the central light source block is LA and a luminance of the corner light source block is LB, the luminance compensating part may apply the backlight compensating signal to the corner light source block according to LA/LB.

In an exemplary embodiment of the present invention, when a luminance of the central light source block is LA and a luminance of the corner light source block is LB, the luminance compensating part may apply the backlight compensating signal to the central light source block according to LB/LA.

In an exemplary embodiment of the present invention, the display panel may include a first corner adjacent display area adjacent to the corner display area in a first direction and a second corner adjacent display area adjacent to the corner display area in a second direction. The backlight unit may include a first corner adjacent light source block overlapped with the first corner adjacent display area and a second corner adjacent light source block overlapped with the second corner adjacent display area. The luminance compensating part may generate different compensating values for the central light source block and the first corner adjacent light source block. The luminance compensating part may generate different compensating values for the central light source block and the second corner adjacent light source block.

In an exemplary embodiment of the present invention, when a luminance of the central light source block is LA and a luminance of the first corner adjacent light source block is LC, the luminance compensating part may apply the backlight compensating signal to the first corner adjacent light source block according to LA/LC.

In an exemplary embodiment of the present invention, when a luminance of the corner light source block is LB and a luminance of the first corner adjacent light source block is LC, the luminance compensating part may apply the backlight compensating signal to the first corner adjacent light source block according to LB/LC.

In an exemplary embodiment of the present invention, the display panel driver may include a gate driver configured to output a gate signal to the display panel and a data driver configured to output a data voltage to the play panel. The display panel may include a central display area disposed in a central portion of the display panel and a corner display area relatively farthest from the gate driver and the data driver. The backlight unit may include a plurality of light source blocks corresponding to the display areas. The backlight unit may include a central edge light source block adjacent to the central display area and a corner edge light source block adjacent to the corner display area. The luminance compensating pail may generate different compensating values for the central edge light source block and the corner edge light source block.

In an exemplary embodiment of the present invention, when a luminance of the central edge light source block is LA and a luminance of the corner edge light source block is LB, the luminance compensating part may apply the backlight compensating signal to the corner edge light source block based on LA/LB.

In an exemplary embodiment of the present invention, the display panel may include a first corner adjacent display area adjacent to the corner display area. The backlight unit may include a corner adjacent edge light source block adjacent to the first corner adjacent display area. When a luminance of the central edge light source block is LA and a luminance of the corner adjacent edge light source bock is LC the luminance compensating part may apply the backlight compensating signal to the corner adjacent edge light source block according to LA/LC.

In an exemplary embodiment of the present invention, the display apparatus may include a driving controller configured to receive input image data and an input control signal and outputs control signal to the display panel driver. The driving controller may include the luminance compensating part.

In an exemplary embodiment of the present invention, the luminance compensating part may apply a local dimming signal according to target grayscales of the input image data for the display areas to the compensating values according to the distance between the display panel driver and the display areas of the display panel to generate a backlight driving signal.

In an exemplary embodiment of the present invention, the display apparatus may include a backlight driver connected to the backlight unit and outputting a backlight driving voltage to the backlight unit. The backlight driver may include the luminance compensating part.

In an exemplary embodiment of the present invention, a method of driving a display apparatus includes outputting a driving signal to a display panel including a plurality of display areas. The method includes outputting light to the display panel based on a backlight compensating signal having different compensating values according to a distance between a display panel driver and the display areas of the display panel.

In an exemplary embodiment of the present invention, the method may include receiving an operation mode of the display panel. The operation mode may include a day mode and a night mode. The backlight compensating signal may be selectively generated when the operation mode is the night mode.

In an exemplary embodiment of the present invention, the method may include comparing a target luminance of an image displayed on the display panel to a threshold luminance. The backlight compensating signal may be selectively generated when the target luminance of the image displayed on the display panel is less than the threshold luminance.

In an exemplary embodiment of the present invention, the method may include sensing a luminance of an image displayed on the display panel and sensing a luminance of an image displayed on the display panel. The backlight compensating signal may be selectively generated when the sensed luminance is less than the threshold luminance.

In an exemplary embodiment of the present invention, the method may include applying a higher intensity backlight compensating signal to a first display area of the plurality of display areas that is relatively further from the display panel driver than a second display area of the plurality of display areas that is relatively closer to the display panel driver.

According to an exemplary embodiment of the present invention, in a display apparatus and a method of driving the display apparatus, the intensity of the light of the backlight unit corresponding to the areas of the display panel may be adjusted to compensate for the difference of the luminance between the areas of the display panel due to the delay of the gate signal and the delay of the data voltage. In addition, the difference of the luminance may be compensated according to a mode of the display panel and a target luminance of the display panel and thus the display quality of the display panel may be increased and the power consumption may be maintained at a relatively low level.

BRIEF DESCRIPTION OF THE DRAWINGS

A more complete appreciation of the present invention will become more apparent by describing in detail exemplary embodiments thereof with reference to the accompanying drawings, in which.

DETAILED DESCRIPTION OF THE INVENTIVE CONCEPT

Figure 1:
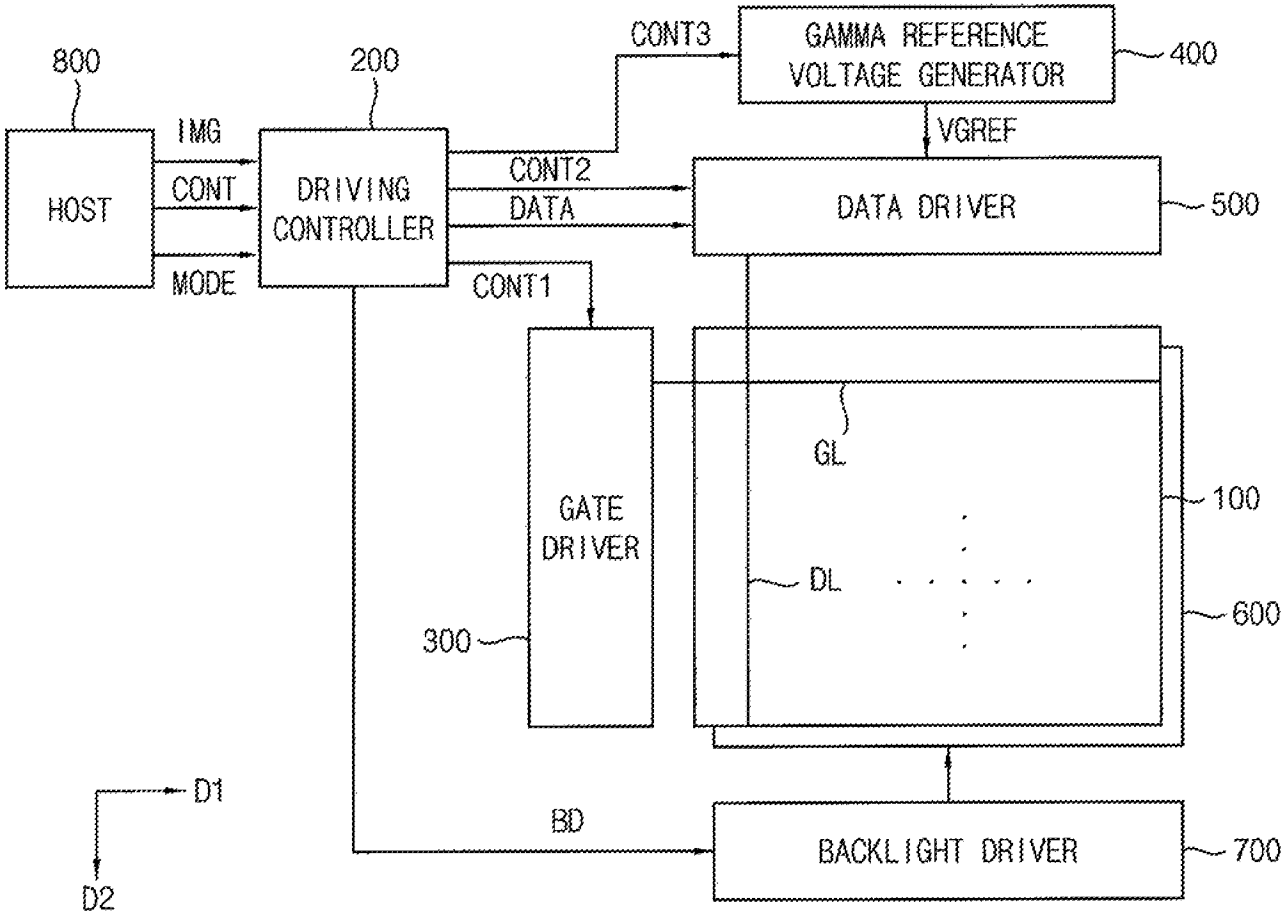
FIG. 1 is a block diagram of a display apparatus according to an exemplary embodiment of the present invention.

Exemplary embodiments of the present invention will be described below in more detail with reference to the accompanying drawings. In this regard, the exemplary embodiments may have different forms and should not be construed as being limited to the exemplary embodiments of the present invention described herein.

Like reference numerals may refer to like elements throughout the specification and drawings.

FIG. 1 is a block diagram of a display apparatus according to an exemplary embodiment of the present invention.

Referring to FIG. 1, display apparatus may include a display panel 100, a display panel driver, a backlight unit 600, a backlight driver 700 and a host 800. The display panel driver may include a driving controller 200, a gate driver 300, a gamma reference voltage generator 400 and a data driver 500. Thus, the driving controller 200, the gate driver 300, the gamma reference voltage generator 400, and/or the data driver 500 may be referred to (e.g., may be collectively referred to) as the display panel driver herein.

The display panel 100 may include a display region and a peripheral region adjacent to the display region. For example, the display panel 100 may be a liquid crystal display panel including a liquid crystal layer. The peripheral region may be positioned at four sides of the display region (e.g., may surround the display region) in a plan view; however, exemplary embodiments of the present invention are not limited thereto. For example, the peripheral region may be arranged at less than four side (e.g., at three sides) of the display region.

The display panel 100 may include a plurality of gate lines GL, plurality of data lines DL and a plurality of pixels electrically connected to the gate lines GL and the data lines DL. The gate lines GL may extend in a first direction D1 and the data lines DL may extend in a second direction D2 crossing the first direction D1 (e.g., perpendicular to the first direction); however, exemplary embodiments of the present invention are not limited thereto, and the gate lines GL and the data lines DL may extend in the second direction D2 and the first direction D1, respectively. The pixels may be spaced apart from each other in the first and/or second directions D1 and D2. For example, the pixels may be arranged in rows and columns to form a matrix configuration.

The driving controller 200 may receive input image data IMG and an input control signal CONT from the host 800. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a third control signal CONT3 and a data signal DATA based on the input image data IMG and the input control signal CONT.

The driving controller 200 may generate the first control signal CONT1 controlling an operation of the gate driver 300 based on the input control signal CONT, and may output the first control signal CONT1 to the gate driver 300. The first control signal CONT1 may include a vertical start signal and a gate clock signal.

The driving controller 200 may generate the second control signal CONT2 controlling an operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 controlling an operation of the gamma reference voltage generator 400 based on the input control signal CONT, and may output the third control signal CONT3 to the gamma reference voltage generator 400.

The driving controller 200 may generate a backlight driving signal BD based on the input image data IMG and an operation mode (e.g., a dimming mode) MODE and may output the backlight driving signal BD to the backlight driver 700.

In an exemplary embodiment of the present invention, the driving controller 200 may include a luminance compensating part generating a backlight compensating signal to compensate for the difference of the luminance between the areas of the display panel 100 due to the delay of the gate signal and the delay of the data voltage. For example, areas of the display panel 100 relatively distant from the display panel driver may experience a delay in receiving the gate signal and the data voltage. Thus, as a distance from the display panel driver increases, a delay in receipt of the gate signal and the data voltage may increase. The delay of the gate signal may be determined by a distance between the area of the display panel 100 and the gate driver 300. The delay of the data voltage may be determined by a distance between the area of the display panel 100 and the data driver 500.

The gate driver 300 may generate gate signals driving the gate lines GL in response to the first control signal CONT1 received from the driving controller 200. For example, the gate driver 300 may sequentially output the gate signals to the gate lines GL.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to a level of the data signal DATA.

In an exemplary embodiment of the present invention, the gamma reference voltage generator 400 may be disposed in the driving controller 200, or in the data driver 500.

The data driver 500 may receive the second control signal CONT2 and the data signal DATA from the driving controller 200, and may receive the gamma reference voltages VGREF from the gamma reference voltage generator 400. The data driver 500 may convert the data signal DATA into data, voltages having an analog type using the gamma reference voltages VGREF. The data driver 500 may output the data voltages to the data lines DL.

In an exemplary embodiment of the present invention, the driving controller 200 and the data driver 500 may be integrally formed. For example, the driving controller 200 and the data driver 500 may be included in a single structure.

The backlight unit 600 may provide light to the display panel 100. The backlight unit 600 may be disposed under the display panel 100. For example, the backlight unit 600 may include a plurality of light emitting diodes.

The backlight driver 700 may convert the backlight driving signal BD into a backlight driving voltage. The backlight driver 700 may output the backlight driving voltage to the backlight unit 600. For example, the backlight driver 700 may include a DC to DC converter, which may increase a voltage level.

Figure 2:
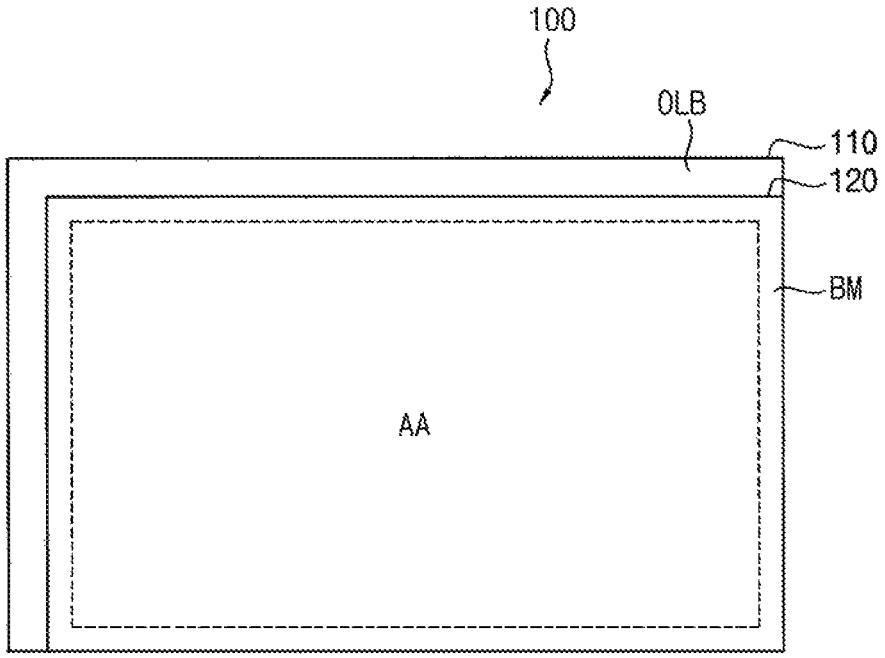
FIG. 2 is a conceptual diagram of a display panel of FIG. 1.
Figure 3:
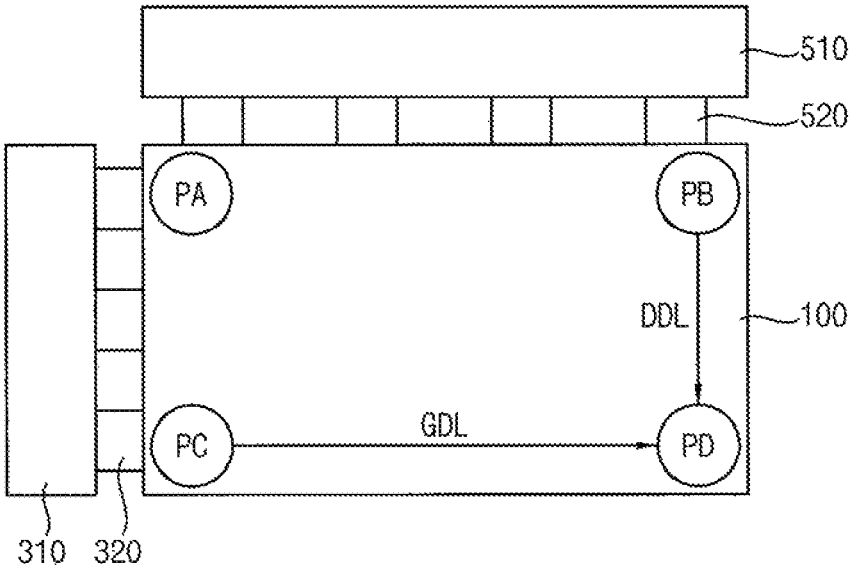
FIG. 3 is a conceptual diagram of a display panel, a gate driver and a data driver of FIG. 1.
Figure 4:
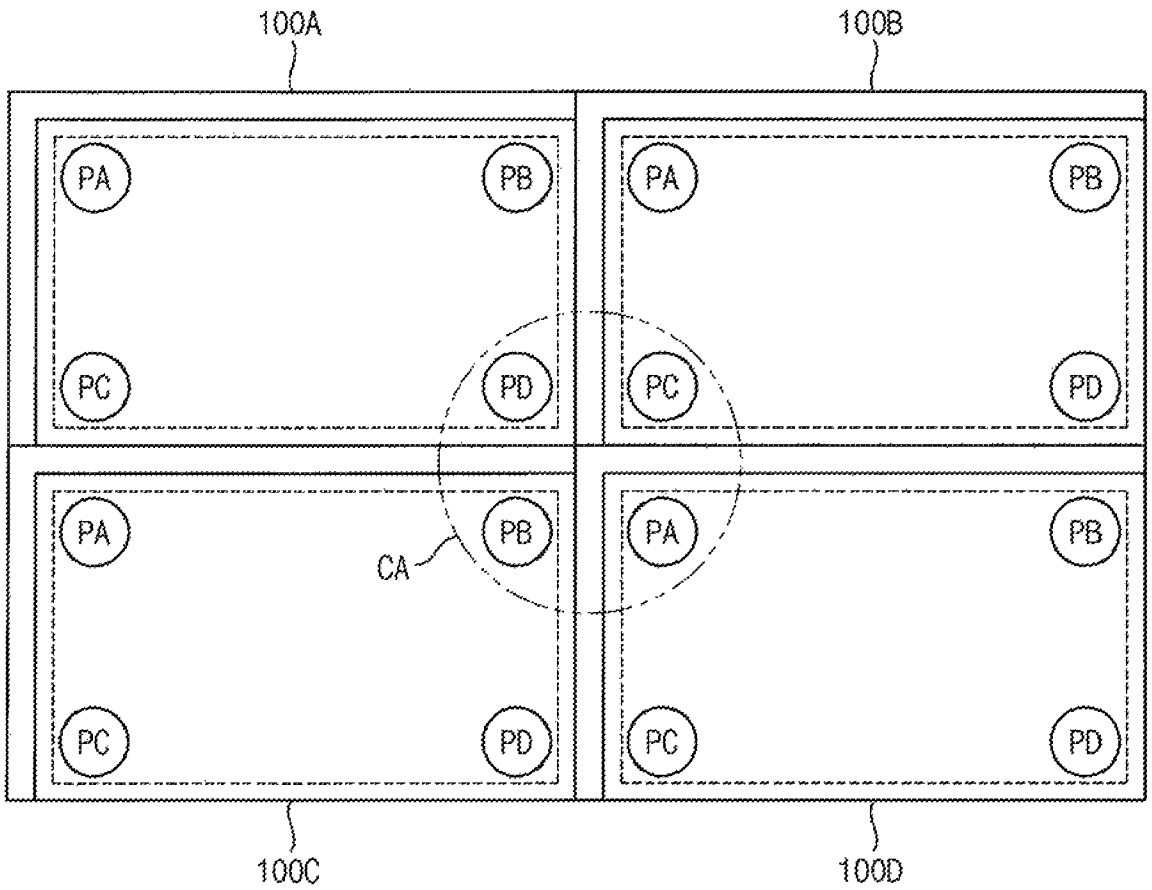
FIG. 4 is a conceptual diagram of a plurality of display apparatuses of FIG. 1 disposed adjacent to each other.

FIG. 2 is a conceptual diagram of a display panel of FIG. 1. FIG. 3 is a conceptual diagram of a display panel, a gate driver and a data driver of FIG. 1. FIG. 4 is a conceptual diagram of a plurality of display apparatuses of FIG. 1 disposed adjacent to each other.

Referring to FIGS. 1 to 4, the display panel 100 may include a first substrate 110 and a second substrate 120 facing the first substrate 110. A liquid crystal layer may be disposed between the first substrate 110 and the second substrate 120.

The first substrate 110 may be a switching element substrate including a plurality of switching elements and a plurality of pixel electrodes connected to the switching elements. The switching elements may be thin film transistors. The gate lines GL and the data lines DL connected to the switching elements may be disposed on the first substrate 110.

The second substrate may be a color filter substrate including a common electrode facing the pixel electrodes and color filters representing colors based on the light passing through the liquid crystal layer.

A size (e.g., a length and/or width) of the first substrate 110 may be greater than a size (e.g., length and/or width) of the second substrate 120. An area of the first substrate 110 not overlapped with the second substrate 120 may be a bonding area OLB. Thus, an upper surface of the first substrate 110 may be exposed by the second substrate 120. The gate driver 300 and/or the data driver 500 may be attached to the bonding area OLB. Thus, the gate driver 300 and/or the data driver 500 may be in direct contact with the upper surface of the first substrate 110 exposed by the second substrate 120.

Edge portions of an area at which the first substrate 110 and the second substrate 120 are overlapped may be referred to a light blocking area BM. Signal lines transmitting signals, a common voltage line transmitting the common voltage to the second substrate 120, a fanout portion of the gate lines GL, a fanout portion of the data lines DL and a sealant to attach the first substrate 110 and the second substrate 120 may be disposed at the light blocking area BM.

A central portion of the area at which the first substrate 110 and the second substrate 120 are overlapped surrounded by the edge portions may be referred to an active area AA. Thus, the active area may be substantially centered on the second substrate 120 (e.g., without reference to a length/width of the first substrate 110).

The data driver 500 may be disposed at a first side of the display panel 100 and the gate driver 300 may be disposed at a second side of the display panel 100 perpendicular to the first side of the display panel 100; however, exemplary embodiments of the present invention are not limited thereto. For example, the data driver 500 may be disposed at a first side of the display panel 100 and the gate driver 300 may be disposed at a third side of the display panel 100 opposite the fast side of the display panel 100

Referring to FIG. 3, the data driver 500 may include a data printed circuit board 510 and a data flexible printed circuit 520 connecting the data printed circuit board 510 and the display panel 100. A data driving chip may be disposed on the data flexible printed circuit 520. Alternatively, the data driver 500 may be mounted on the display panel 100 or integrated on the display panel 100. The gate driver 300 may include a gate printed circuit board 310 and a gate flexible printed circuit 320 connecting the gate printed circuit hoard 310 and the display panel 100. A gate driving chip may be disposed on the gate flexible printed circuit 320. Alternatively, the gate driver 300 may be mounted on the display panel 100 or integrated on the display panel 100.

The delay of the data voltage and the delay of the gate signal of areas PA, PB, PC or PD of the display panel 100 may vary according to relative positions between the areas PA, PB, PC or PD of the display panel 100, the gate driver 300 and the data driver 500. For example, areas of the areas PA, PB, PC or PD that are relatively more distant from the display panel driver may experience a greater delay in receiving the data voltage and the gate signal.

The data voltage may be transmitted from the first side of the display panel 100 to a third side of the display panel 100 facing the first side of the display panel 100. The gate signal may be transmitted from the second side of the display panel 100 to a fourth side of the display panel 100 facing the second side of the display panel 100. The delay of the data voltage and the delay of the gate signal may be generated due to resistance of the data lines and the gate lines when the data voltage and the gate signal pass the active area AA of the display panel 100. Thus, the data voltage applied to the pixels adjacent to the third side may be later than the data voltage applied to the pixels adjacent to the first side. In addition, the gate signal applied to the pixels adjacent to the fourth side may be later than the gate signal applied to the pixels adjacent to the second side.

In the area of PA, the distance from the gate driver 300 to the area of PA and the distance from the data driver 500 to the area of PA are relatively short and thus the delay GDL of the gate signal and the delay DDL of the data voltage might not be generated. In the area of PB, the distance from the gate driver 300 to the area of PB is relatively long and thus the delay GDL of the gate signal may be generated. In the area of PB, the distance from the data driver 500 to the area of PB is relatively short and thus the delay DDL of the data voltage might not be generated. In the area of PC, the distance from the data driver 500 to the area of PC is relatively long and thus the delay DDL of the data voltage may be generated. In the area of PC, the distance from the gate driver 300 to the area of PB is relatively short and thus the delay GDL of the gate signal need not be generated. In the area of PD, the distance from the gate driver 300 to the area of PD and the distance from the data driver 500 to the area of PD are relatively long and thus the delay GDL of the gate signal and the delay DDL of the data voltage may be generated.

When the gate signal and the data voltage are delayed, the level of the data voltage may be decreased or a charging time of the data voltage may be decreased so that the luminance of the area may be decreased. Due to the delay of the gate signal and the data voltage, the luminance of the area of PB and the area of PC may be decreased. Due to the delay of the gate signal and the data voltage, the luminance of the area of PD may be further decreased.

Referring to FIG. 4, four display apparatuses may be disposed adjacent to each other in two rows and two columns. The display apparatuses may be disposed adjacent to each other for an outdoor billboard or an outdoor direction board. When the display panels 100A, 100B, 100C and 100D are disposed adjacent to each other, the area of PD a first display panel 100A at which the gate signal and the data voltage are delayed may be adjacent to the area of PA of a fourth display panel 100D at which the gate signal and the data voltage are not delayed at a central area CA of the display panels 100A, 100B, 100C and 100D. Thus, the decrease of the luminance of the area of PD of the first display panel 100A may strongly stand out to a user.

Figure 5:
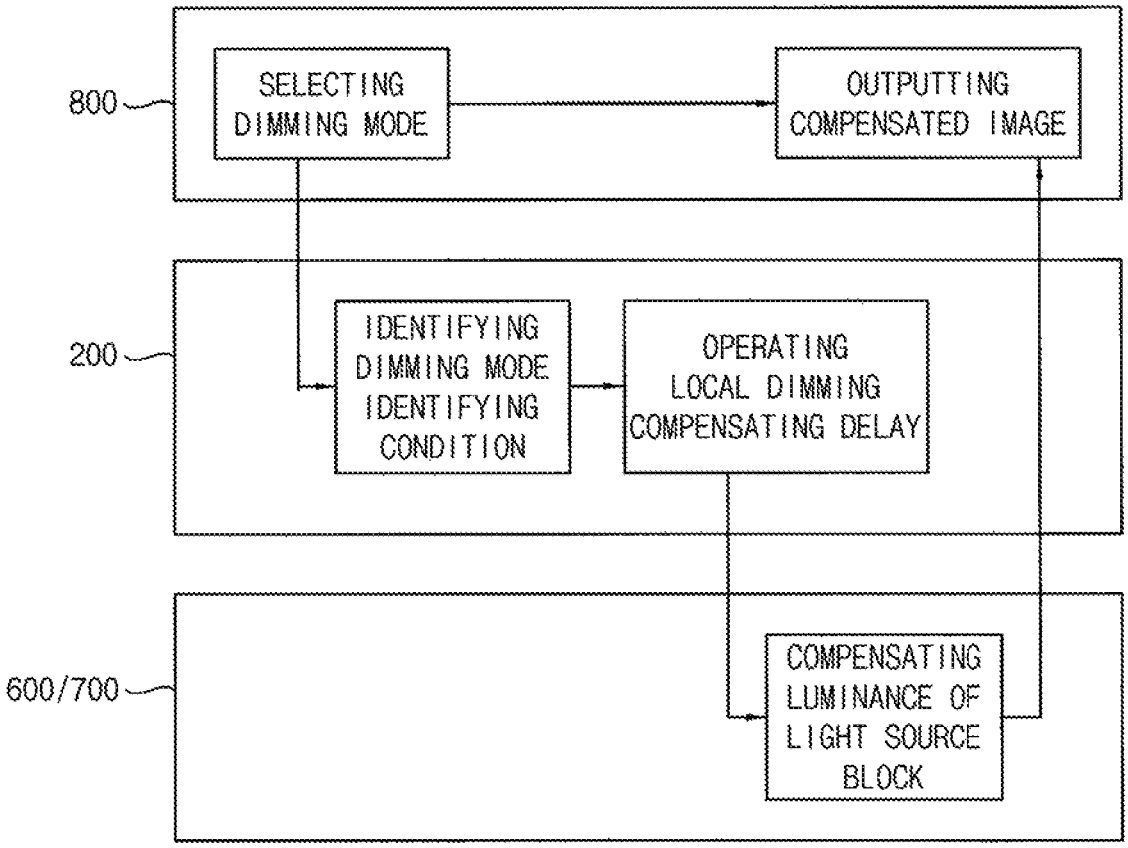
FIG. 5 is a block diagram of an operation of a host, a driving controller, a backlight driver and a backlight unit of FIG. 1.
Figure 6A:
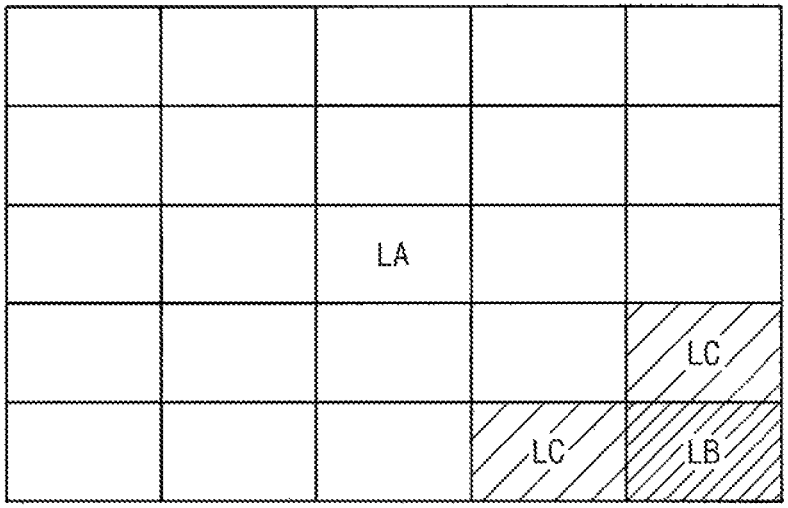
FIG. 6A is a conceptual diagram of display areas of a display panel of FIG. 1 and a luminance compensation of a driving controller of FIG. 1.
Figure 6B:
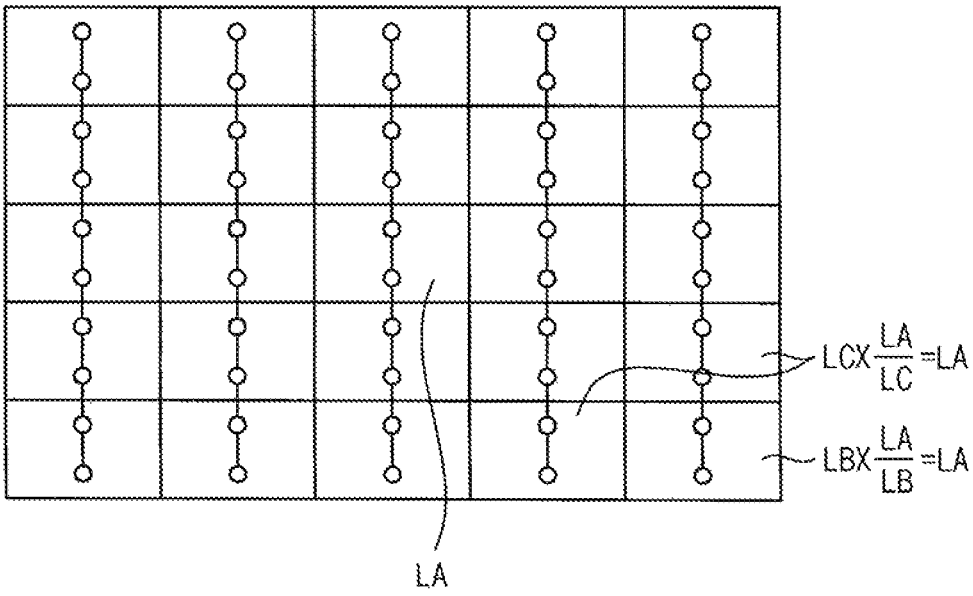
FIG. 6B is a conceptual diagram of light source blocks of a backlight unit of FIG. 1 and a luminance compensation of a driving controller of FIG. 1.

FIG. 5 is a block diagram of an operation of a host, a driving controller, a backlight driver and a backlight unit of FIG. 1. FIG. 6A is a conceptual diagram of display areas of a display panel of FIG. 1 and a luminance compensation of a driving controller of FIG. 1. FIG. 6B is a conceptual diagram of light source blocks of a backlight unit of FIG. 1 and a luminance compensation of a driving controller of FIG. 1.

Referring to FIGS. 1 to 6B, the driving controller 200 may include a luminance compensating part generating a backlight compensating signal to compensate for the difference of the luminance between the areas of the display panel 100 due to the delay GDL of the gate signal and the delay DDL of the data voltage. The delay GDL of the gate signal may be generated according to the distance between the area of the display panel 100 and the gate driver 300. The delay DDL of the data voltage may be generated according to the distance between the area of the display panel 100 and the data driver 500.

The luminance compensating part may receive the operation mode (e.g., the dimming mode) MODE. For example, the operation mode MODE may include a day mode and a night mode. The display panel 100 may be installed in outdoor displays and thus may display an image in a relatively high luminance in a day time and in a relatively low luminance in a night time. The difference of the luminance between the areas of the display panel 100 due to the delay GDL of the gate signal and the delay DDL of the data voltage may be generated regardless of the level of the luminance. The difference of the luminance may be perceived less to the user in relatively high luminance. The difference of the luminance may be perceived relatively more to the user in relatively low luminance.

Thus, the luminance compensating part may generate the backlight compensating signal to compensate the difference of the luminance between the areas of the display panel 100 when the operation mode MODE is the night mode.

Alternatively, the luminance compensating part may selectively generate the backlight compensating signal to compensate the difference of the luminance between the areas of the display panel 100 according to a target luminance of the input image data IMG displayed on the display panel 100. For example, the luminance compensating part may generate the backlight compensating signal to compensate for the difference of the luminance between the areas of the display panel 100 when the target luminance of the input image data IMG is less than a threshold luminance. The target luminance may be determined by averaging the input image data IMG for an entire area of the display panel 100 for a frame. Alternatively, the target luminance may be determined by averaging the input image data IMG for a luminance compensating area of the display panel 100 for a frame.

Referring to FIGS. 6A and 6B, the display panel 100 may include a plurality of display areas. The backlight unit 600 may include a plurality of light source blocks corresponding to the display areas. The display area may include a plurality of pixels. For example, the display areas may have the same size as each other. The display areas may be conceptually defined but need not be physically defined. For example, each of the display areas may be positioned on a single display panel without a bezel or physical barrier between the display areas. The light source blocks may refer to areas of the backlight unit 600 overlapped with the display areas.

In an exemplary embodiment of the present invention, the backlight unit 600 may be a direct type backlight unit. The backlight unit 600 may includes plurality of light emitting diodes. For example, in the direct type backlight unit, the light source block may be overlapped with the display area and may include a plurality of light sources.

The display areas may be arranged in areas of five by five and the light source blocks may be arranged in areas of five by five (see, e.g., FIGS. 6A and 6B); however, exemplary embodiments of the present invention are not limited to a particular number of the display areas or a particular number of the light source blocks.

The display panel 100 may include a central display area (e.g., a luminance area of LA) disposed in a central portion of the display panel 100 and a corner display area (e.g., a luminance area of LB) disposed relatively farthest from the gate driver 300 and the data driver 500.

The corner display area (e.g., the luminance area of LB) may have a luminance lower than a luminance of the central display area the luminance area of LA) due to the delay GDL of the gate signal and the delay DDL of the data voltage.

The backlight unit 600 may include a central light source block overlapped with the central display area and a corner light source block overlapped with the corner display area.

The luminance compensating part may generate different compensating values for the central light source block and the corner light source block.

The backlight compensation signal described in more detail below with reference to LA, LB and LC may include a step of dividing a first luminance (e.g., LA) by a second luminance (e.g., LB) and applying the resulting value to generating the backlight compensating signal. For example, if LA has a value of 8 and LB has a value of 6 then LA divided by LB is 1.33 and a backlight compensation signal having a value of 1.33 may be applied (e.g., to increase the luminance of corner light source block originally having LB). Thus, a luminance of the light block receiving the backlight compensation signal (e.g., a light block represented in the denominator above) may be increased and the resulting luminance of the light block receiving the backlight compensation signal may be substantially equal to a reference light block (e.g., a light block represented in the numerator above).

When the luminance of the central light source block is LA and the luminance of the corner light source block is LB, the luminance compensating part may apply a value determined by LA/LB to generate the backlight compensating signal and the generated backlight compensating signal may be applied to the corner light source block. When the compensating value of LA/LB is applied to the luminance of the corner light source block, the luminance of the corner light source block becomes the luminance of LA which is equal to the luminance of the central light source block so that the uniformity of the luminance of the display panel 100 may be increased.

The display panel 100 may include a first corner adjacent display area (e.g., a first luminance area of LC) which is adjacent to the corner display area (e.g., the luminance area of LB) in a first direction and a second corner adjacent display area (e.g., a second luminance area of LC) which is adjacent to the corner display area (e.g., the luminance area of LB) in a second direction.

The first corner adjacent display area (e.g., the first luminance area of LC) may have a luminance lower than the luminance of the central display area (e.g., the luminance area of LA) due to the delay GDL of the gate signal and the delay DDL of the data voltage. The second corner adjacent display area (e.g., the second luminance area of LC) may have a luminance lower than the luminance of the central display area (e.g., the luminance area of LA) due to the delay GDL of the gate signal and the delay DDL of the data voltage.

The first corner adjacent display area (e.g., the first luminance area of LC) may have a luminance higher than the luminance of the corner display area (e.g., the luminance area of LB) since the delay GDL of the gate signal of the first corner adjacent display area (e.g., the first luminance area of LC) is less than the delay GDL of the gate signal of the corner display area (e.g., the luminance area of LB). In addition, the second corner adjacent display area (e.g., the second luminance area of LC) may have a luminance higher than the luminance of the corner display area (e.g., the luminance area of LB) since the delay DDL of the data voltage of the second corner adjacent display area (e.g., the second luminance area of LC) is less than the delay DDL of the data voltage of the corner display area (e.g., the luminance area of LB). Although the luminance of the first corner adjacent display area may be substantially the same as the luminance of the second corner adjacent display area exemplary embodiments of the present invention are not limited thereto, and the luminance of the first corner adjacent display area may be different from the luminance of the second corner adjacent display area according to the characteristics of the display panel 100.

The backlight unit 600 may further include a first corner adjacent light source block overlapped with the first corner adjacent display area and a second corner adjacent light source block overlapped with the second corner adjacent display area.

The luminance compensating part may generate different compensating values for the central light source block and the first corner adjacent light source block. The luminance compensating part may generate different compensating values for the central light source block and the second corner adjacent light source block.

In addition, the luminance compensating part may generate different compensating values for the corner light source block and the first corner adjacent light source block. The luminance compensating part may generate different compensating values for the corner light source block and the second corner adjacent light source block.

When the luminance of the central light source block is LA and the luminance of the first corner adjacent light source block is LC, the luminance compensating part may apply a value determined by LA/LC to generate the backlight compensating signal and the generated backlight compensating signal may be applied to the first corner adjacent light source block. When the compensating value of LA/LC is applied to the luminance of the first corner adjacent light source block, the luminance of the first corner adjacent light source block becomes the luminance of LA which is substantially equal to the luminance of the central light source block so that the uniformity of the luminance of the display panel 100 may be increased.

When the luminance of the central light source block is LA and the luminance of the second corner adjacent light source block is LC, the luminance compensating part may apply a value determined by LA/LC to generate the backlight compensating signal and the generated backlight compensating signal may be applied to the second corner adjacent light source block. When the compensating value of LA/LC is applied to the luminance of the second corner adjacent light source block, the luminance of the second corner adjacent light source block becomes the luminance of LA which is substantially equal to the luminance of the central light source block so that the uniformity of the luminance of the display panel 100 may be increased. Similarly, when the luminance of the central light source block is LA and the luminance of the corner light source block is LB, the luminance compensating part may apply a value determined by LA/LB to generate the backlight compensating signal and the generated backlight compensating signal may be applied to the corner light source block In an exemplary embodiment of the present invention, the luminance of the corner light source block farthest from the gate driver and the data driver and the luminances of the corner adjacent light source blocks adjacent to the corner light source block may be adjusted based on the luminance of the central light source block. A user generally concentrates on the central display, and thus using the central display as a reference luminance to generate a backlight compensation signal may result in an appearance of a substantially uniform luminance across the entire display panel. When the luminances of the corner light source block and the corner adjacent light source blocks are adjusted based on the luminance of the central light source block, the difference of the luminance between the areas of the display panel 100 may be compensated for.

Although the luminance of the corner light source block farthest from the gate driver and the data driver and the luminances of the corner adjacent light source blocks adjacent to the corner light source block may be adjusted based on the luminance of the central light source block in an exemplary embodiment of the present invention, exemplary embodiments of the present invention are not limited thereto. For example, the luminance of the corner light source block farthest from the gate driver and the data driver and the luminances of the corner adjacent light source blocks adjacent to the corner light source block may be adjusted based on a luminance of a second corner light source block closest relatively closest to the gate driver and the data driver.

The driving controller 200 may operate the local dimming so that the luminances of the light source blocks may be adjusted according to target grayscales of the display areas. For example, the luminance of the light source block corresponding to the display area having a relatively high target luminance may be increased. The luminance of the light source block corresponding to the display area having a relatively low target luminance may be decreased. For example, the light source block corresponding to the display area having a minimum target luminance may be turned off. Due to the local dimming method, the power consumption of the display apparatus may be reduced and the display quality of the display apparatus may be increased.

The luminance compensating part may generate the backlight driving signal by adding the luminance compensating value for compensating the difference of the luminance between the areas of the display panel 100 (e.g., as described above with reference to FIGS. 5 to 6B) to the local dimming signal according to the target grayscales of the display area of the input image data IMG.

For example, when the luminance of the first light source block according to the local dimming is 50 and the luminance compensating value of the first light source block is +5, the luminance compensating part may generate the backlight driving signal of the first light source block having the luminance of 55.

For example, when the luminance of the second light source block according to the local dimming is 50 and the luminance compensating value of the second light source block is zero, the luminance compensating part may generate the backlight driving signal of the second light source block having the luminance of 50.

For example, when the luminance of the third light source block according to the local dimming is 25 and the luminance compensating value of the third light source block is +5, the luminance compensating part may generate the backlight driving signal of the third light source block having the luminance of 30.

According to an exemplary embodiment of the present invention, the intensity of the light of the backlight unit 600 corresponding to the areas of the display panel 100 may be adjusted to compensate for the difference of the luminance between the areas of the display panel 100 due to the delay GDL of the gate signal and the delay DDL of the data voltage. In addition, the difference of the luminance may be compensated according to the operation mode MODE of the display panel 100 or the target luminance of the display panel 100 so that the display quality of the display panel 100 may be increased and the power consumption may be maintained at a relatively low level.

Figure 7A:
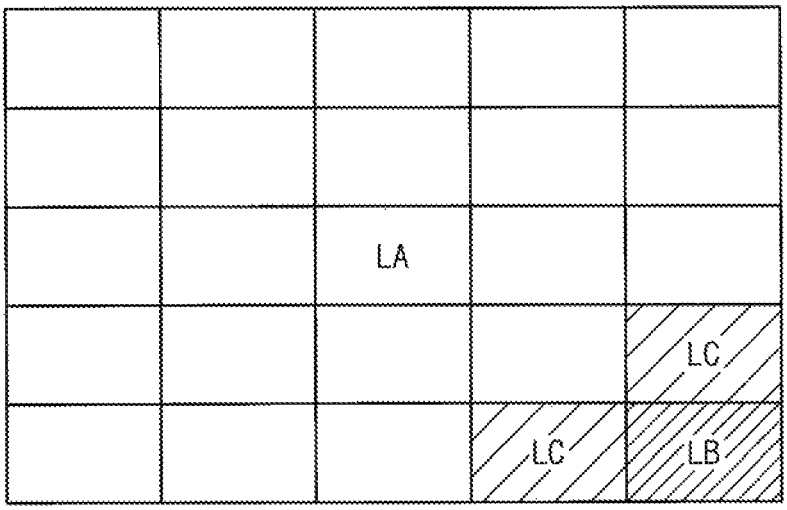
FIG. 7A is a conceptual diagram of display areas of a display panel of a display apparatus according to an exemplary embodiment of the present invention and a luminance compensation of a driving controller of a display apparatus.
Figure 7B:
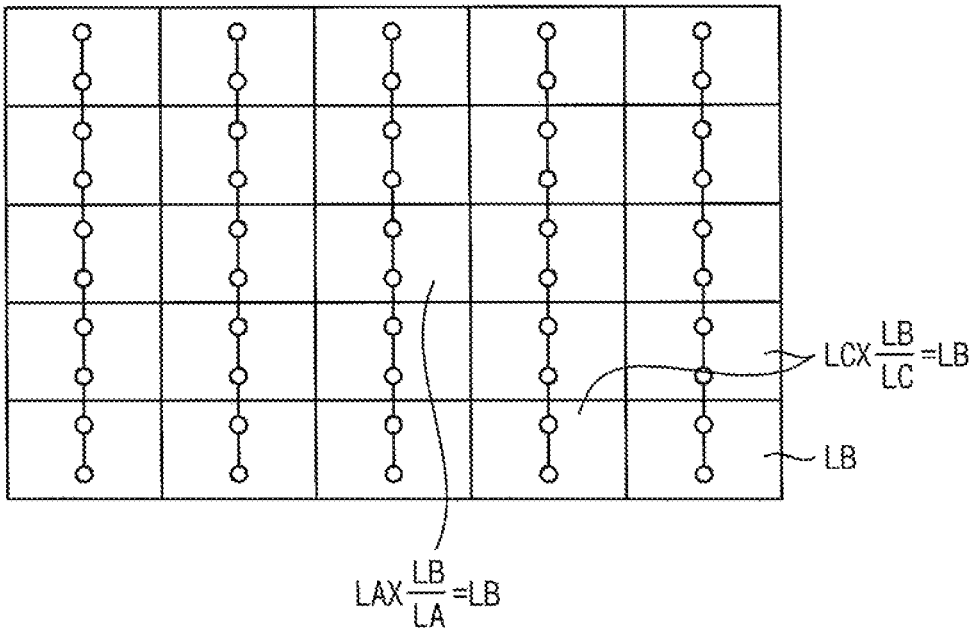
FIG. 7B is a conceptual diagram of light source blocks of a backlight unit of a display apparatus of FIG. 7A and a luminance compensation of a driving controller of a display apparatus of FIG. 7A.

FIG. 7A is a conceptual diagram of display areas of a display panel of a display apparatus according to an exemplary embodiment of the present invention and a luminance compensation of a driving controller of a display apparatus. FIG. 7B is a conceptual diagram of light source blocks of a backlight unit of a display apparatus of FIG. 7A and a luminance compensation of a driving controller of a display apparatus of FIG. 7A.

The display apparatus according to an exemplary embodiment of the present invention described below with reference to FIGS. 7A and 7B may be substantially the same as the display apparatus according to an exemplary embodiment of the present invention described above with reference to FIGS. 1 to 6B except for the method of compensating the luminance of the luminance compensating part. Thus, duplicative descriptions to those described above may be omitted below with reference to FIGS. 7A and 7B.

Referring to FIGS. 1 to 5, 7A and 7B, the display apparatus may include the display panel 100, the display panel driver, the backlight unit 600, the backlight driver 700 and the host 800. The display panel driver may include the driving controller 200, the gate driver 300, the gamma reference voltage generator 400 and the data driver 500.

The driving controller 200 may include the luminance compensating part generating a backlight compensating signal to compensate for the difference of the luminance between the areas of the display panel 100 due to the delay GDL of the gate signal and the delay DDL of the data voltage. The delay GDL of the gate signal may be generated according to the distance between the area of the display panel 100 and the gate driver 300. The delay DDL of the data voltage may be generated according to the distance between the area of the display panel 100 and the data driver 500.

The luminance compensating part may receive the operation mode (e.g., the dimming mode) MODE. The luminance compensating part may generate the backlight compensating signal to compensate for the difference of the luminance between the areas of the display panel 100 when the operation mode MODE is the night mode.

Alternatively, the luminance compensating part may selectively generate the backlight compensating signal to compensate for the difference of the luminance between the areas of the display panel 100 according to a target luminance of the input image data IMG displayed on the display panel 100. For example, the luminance compensating part may generate the backlight compensating signal to compensate for the difference of the luminance between the areas of the display panel 100 when the target luminance of the input image data IMG is less than a threshold luminance.

Referring to FIGS. 7A and 7B, the display panel 100 may include a plurality of display areas. The backlight unit 600 may include a plurality of light source blocks corresponding to the display areas. The display areas may each include a plurality of pixels. The light source blocks may refer to areas of the backlight unit 600 overlapped with the display areas.

In an exemplary embodiment of the present invention, the backlight unit 600 may be a direct type backlight unit. The backlight unit 600 may include a plurality of light emitting diodes.

The display panel 100 may include a central display area (e.g., a luminance area of LA) disposed in a central portion of the display panel 100 and a corner display area (e.g., a luminance area of LB) disposed relatively farthest from the gate driver 300 and the data driver 500.

The corner display area (e.g., the luminance area of LB) may have a luminance lower than a luminance of the central display area (e.g., the luminance area of LA) due to the delay GDL of the gate signal and the delay DDL of the data voltage.

The backlight unit 600 may include a central light source block overlapped with the central display area and a corner light source block overlapped with the corner display area.

The luminance compensating part may generate different compensating values for the central light source block and the corner light source block.

When the luminance of the central light source block is LA and the luminance of the corner light source block is LB, the luminance compensating part may apply a value determined by LB/LA to generate the backlight compensating signal and the generated backlight compensating signal may be applied to the central light source block. When the compensating value of LB/LA is applied to the luminance of the central light source block, the luminance of the central light source block becomes the luminance of LB which is substantially equal to the luminance of the corner light source block so that the uniformity of the luminance of the display panel 100 may be increased. In addition, the overall luminance of the light source block may be decreased to compensate for the difference of the luminance so that the power consumption of the display apparatus may be reduced.

Like the central light source block (e.g., the luminance area of LA), luminances of light source blocks adjacent to the central light source block (e.g., the luminance area of LA) and having relatively high luminances may be compensated in the same way as the central light source block (e.g., the luminance area of LA).

The display panel 100 may further include a first corner adjacent display area (e.g., a first luminance area of LC) which is adjacent to the corner display area (e.g., the luminance area of LB) in a first direction and a second corner adjacent display area (e.g., a second luminance area of LC) which is adjacent to the corner display area (e.g., the luminance area of LB) in a second direction.

The backlight unit 600 may further include a first corner adjacent light source block overlapped with the first corner adjacent display area and a second corner adjacent light source block overlapped with the second corner adjacent display area.

The luminance compensating part may generate different compensating values for the central light source block and the first corner adjacent light source block. The luminance compensating part may generate different compensating values for the central light source block and the second corner adjacent light source block.

In addition, the luminance compensating part may generate different compensating values for the corner light source block and the first corner adjacent light source block. The luminance compensating part may generate different compensating values for the corner light source block and the second corner adjacent light source block.

When the luminance of the corner light source block is LB and the luminance of the first corner adjacent light source block is LC, the luminance compensating part may apply a value determined by LB/LC to generate the backlight compensating signal and the generated backlight compensating signal may be applied to the first corner adjacent light source block. When the compensating value of LB/LC is applied to the luminance of the first corner adjacent light source block, the luminance of the first corner adjacent light source block becomes the luminance of LB which is substantially equal to the luminance of the corner light source block so that the uniformity of the luminance of the display panel 100 may be increased.

When the luminance of the corner light source block is LB and the luminance of the second corner adjacent light source block is LC, the luminance compensating part may apply a value determined by LB/LC to generate the backlight compensating signal and the generated backlight compensating signal may be applied to the second corner adjacent light source block. When the compensating value of LB/LC is applied to the luminance of the second corner adjacent light source block, the luminance of the second corner adjacent light source block becomes the luminance of LB which is substantially equal to the luminance of the corner light source block so that the uniformity of the luminance of the display panel 100 may be increased.

In an exemplary embodiment of the present invention, the luminances of the remaining light source blocks may be adjusted based on the luminance of the corner light source block farthest from the gate driver and the data driver. The corner light source block may have the lowest luminance due to the delays of the gate signal and the data voltage. When the luminances of the remaining light source blocks are adjusted based on the luminance of the corner light source block, the difference of the luminance between the areas of the display panel 100 may be compensated for and the power consumption of the display apparatus may be reduced.

The driving controller 200 may operate the local dimming so that the luminances of the light source blocks may be adjusted according to target grayscales of the display areas.

The luminance compensating part may generate the backlight driving signal by adding the luminance compensating value for compensating for the difference of the luminance between the areas of the display panel (e.g., as described with reference to FIGS. 7A and 7B) to the local dimming signal according to the target grayscales of the display area of the input image data IMG.

According to an exemplary embodiment of the present invention, the intensity of the light of the backlight unit 600 corresponding to the areas of the display panel 100 may be adjusted to compensate for the difference of the luminance between the areas of the display panel 100 due to the delay GDL of the gate signal and the delay DDL of the data voltage. In addition, the difference of the luminance may be compensated for according to the operation mode MODE of the display panel 100 or the target luminance of the display panel 100 so that the display quality of the display panel 100 may be increased and the power consumption may be reduced.

Figure 8A:
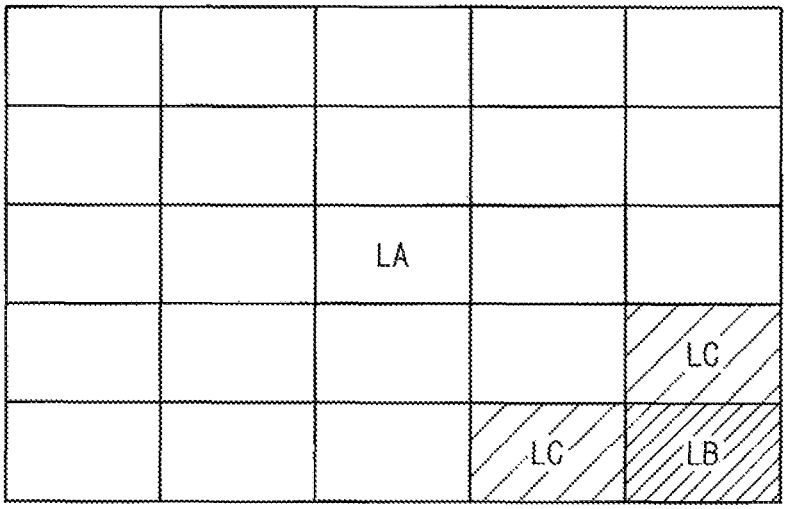
FIG. 8A is a conceptual diagram of display areas of a display panel of a display apparatus according to an exemplary embodiment of the present invention and a luminance compensation of a driving controller of a display apparatus.
Figure 8B:
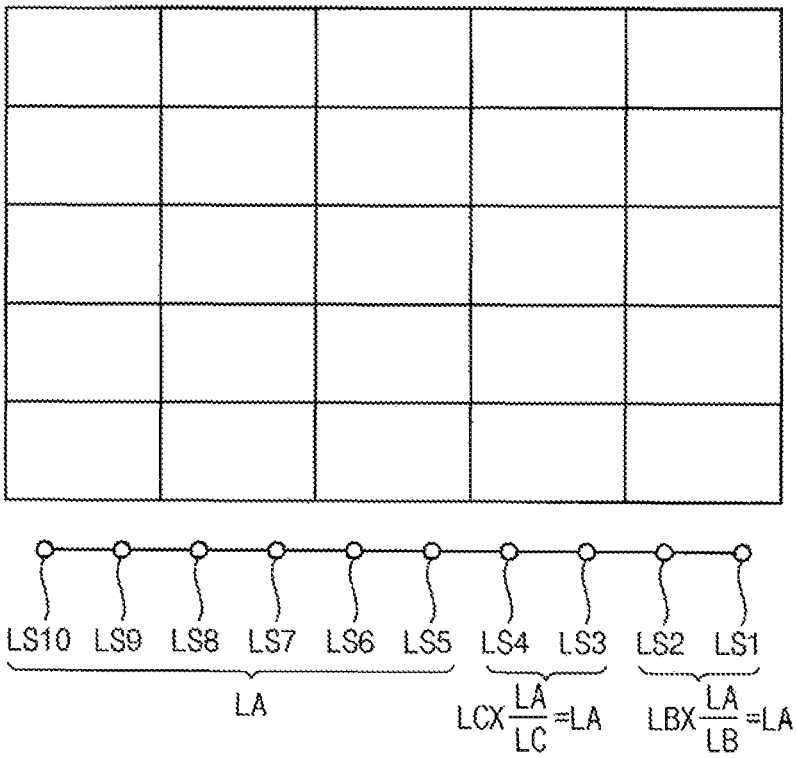
FIG. 8B is a conceptual diagram of light source blocks of a backlight unit of a display apparatus of FIG. 8A and a luminance compensation of a driving controller of a display apparatus of FIG. 8A.

FIG. 8A is a conceptual diagram of display areas of a display panel of a display apparatus according to an exemplary embodiment of the present invention and a luminance compensation of a driving controller of a display apparatus. FIG. 8B is a conceptual diagram of light source blocks of a backlight unit of a display apparatus of FIG. 8A and a luminance compensation of a driving controller of a display apparatus of FIG. 8A.

The display apparatus according to an exemplary embodiment of the present invention described below with reference to FIGS. 8A and 8B may be substantially the same as the display apparatus according to an exemplary embodiment of the present invention described above with reference to FIGS. 1 to 6B except for the structure of the backlight unit and the method of compensating the luminance of the luminance compensating part. Thus, duplicative descriptions to those described above may be omitted below with reference to FIGS. 8A and 8B.

Referring to FIGS. 1 to 5, 8A and 8B, the display apparatus may include the display panel 100, the display panel driver, the backlight unit 600, the backlight driver 700 and the host 800. The display panel driver may include the driving controller 200, the gate driver 300, the gamma reference voltage generator 400 and the data driver 500.

The driving controller 200 may include a luminance compensating part generating a backlight compensating signal to compensate for the difference of the luminance between the areas of the display panel 100 due to the delay GDL of the gate signal and the delay DDL of the data voltage. The delay GDL of the gate signal may be generated according to the distance between the area of the display panel 100 and the gate driver 300. The delay DDL of the data voltage may be generated according to the distance between the area of the display panel 100 and the data driver 500.

Referring to FIGS. 8A and 8B, the display panel 100 may include a plurality of display areas. The backlight unit 600 may include a plurality of light source blocks corresponding to the display areas. The display areas may each include a plurality of pixels. The light source blocks may refer to areas of the backlight unit 600 overlapped with the display areas.

In an exemplary embodiment of the present invention, the backlight unit 600 may be an edge type backlight unit. The backlight unit 600 may include a plurality of light emitting diodes disposed at least a side of the display panel 100. In an exemplary embodiment of the present invention, the light emitting diodes may be disposed at a third side of the display panel 100.

The display panel 100 may include a central display area (e.g., a luminance area of LA) disposed in a central portion of the display panel 100 and a corner display area (e.g., a luminance area of LB) disposed relatively farthest from the gate driver 300 and the data driver 500.

The corner display area e.g., (the luminance area of LB) may have a luminance lower than a luminance of the central display area (e.g., the luminance area of LA) due to the delay GDL of the gate signal and the delay DDL of the data voltage.

The backlight unit 600 may include a central edge light source block (e.g., LS5 and LS6) adjacent to the central display area and a corner edge light source block (e.g. LS1 and LS2) adjacent to the corner display area.

The luminance compensating part may generate different compensating values for the central edge light source block (e.g. LS5 and LS6) and the corner edge light source block (e.g. LS1 and LS2).

When the luminance of the central edge light source block (e.g. LS5 and LS6) is LA and the luminance of the corner edge light source block (e.g. LS1 and LS2) is LB, the luminance compensating part may apply a value determined by LA/LB to generate the backlight compensating signal and the generated backlight compensating signal may be applied to the corner edge light source block (e.g. LS1 and LS2). When the compensating value of LA/LB is applied to the luminance of the corner edge light source block (e.g. LS1 and LS2), the luminance of the corner edge light source block (e.g. LS1 and LS2) becomes the luminance of LA which is substantially equal to the luminance of the center edge light source block (e.g. LS5 and LS6) so that the uniformity of the luminance of the display panel 100 may be increased.

Alternatively, when the luminance of the central edge light source block (e.g. LS5 and LS6) is LA and the luminance of the corner edge light source block (e.g. LS1 and LS2) is LB, the luminance compensating part may apply a value determined by LB/LA to generate the backlight compensating signal and the generated backlight compensation signal may be applied to the central edge light source block (e.g. LS5 and LS6). When the compensating value of LB/LA is applied to the luminance of the central edge light source block (e.g. LS5 and LS6), the luminance of the central edge light source block (e.g. LS5 and LS6) becomes the luminance of LB which is substantially equal to the luminance of the corner edge light source block (e.g. LS1 and LS2) so that the uniformity of the luminance of the display panel 100 may be increased. In addition, the overall luminance of the light source block may be decreased to compensate for the difference of the luminance so that the power consumption of the display apparatus may be reduced.

Like the central edge light source block (e.g. LS5 and LS6), luminances of light source blocks (e.g. LS7 to LS10) adjacent to the central edge light source block (e.g. LS5 and LS6) and having relatively high luminances may be compensated for in the same way as the central edge light source block (e.g. LS5 and LS6).

The display panel 100 may further include a first corner adjacent display area (e.g., a first luminance area of LC) which is adjacent to the corner display area (e.g., the luminance area of LB) in a first direction. The backlight unit 600 may further include a corner adjacent edge light source block (e.g. LS3 and LS4) overlapped with the first corner adjacent display area (e.g., the first luminance area of LC).

When the luminance of the central edge light source block (e.g. LS5 and LS6) is LA and the luminance of the corner adjacent edge light source block (e.g., LS3 and LS4) is LC, the luminance compensating part may apply a value determined by LA/LC to generate the backlight compensating signal and the generated backlight compensating signal may be applied to the corner adjacent edge light source block (e.g. LS3 and LS4). When the compensating value of LA/LC is applied to the luminance of the corner adjacent edge light source block (e.g. LS3 and LS4), the luminance of the corner adjacent edge light source block (e.g. LS3 and LS4) becomes the luminance of LA which is substantially equal to the luminance of the center edge light source block (e.g. LS5 and LS6) so that the uniformity of the luminance of the display panel 100 may be increased.

Alternatively, when the luminance of the corner adjacent edge light source block (e.g. LS3 and LS4) is LC and the luminance of the corner edge light source block (e.g. LS1 and LS2) is LB, the luminance compensating part may apply a value (e.g., a compensating value as described herein) determined by LB/LC to generate the backlight compensating signal and the generated backlight compensating signal be applied to the corner adjacent edge light source block (e.g. LS3 and LS4). When the compensating value of LB/LC is applied to the luminance of the corner adjacent edge light source block (e.g. LS3 and LS4), the luminance of the corner adjacent edge light source block (e.g. LS3 and LS4) becomes the luminance of LB which is substantially equal to the luminance of the corner edge light source block (e.g. LS1 and LS2) so that the uniformity of the luminance of the display panel 100 may be increased. In addition, the overall luminance of the light source block is decreased to compensate for a difference of the luminance so that the power consumption of the display apparatus may be reduced.

The driving controller 200 may operate the local dimming so that the luminances of the light source blocks may be adjusted according to target grayscales of the display areas.

The luminance compensating part may generate the backlight driving signal by adding the luminance compensating value for compensating the difference of the luminance between the areas of the display panel 100 (e.g., as described with reference to FIGS. 8A and 8B) to the local dimming signal according to the target grayscales of the display area of the input image data IMG.

According to an exemplary embodiment of the present invention, the intensity of the light of the backlight unit 600 corresponding to the areas of the display panel 100 may be adjusted to compensate for the difference of the luminance between the areas of the display panel 100 due to the delay GDL of the gate signal and the delay DDL of the data voltage. In addition, the difference of the luminance may be compensated for according to the operation mode MODE of the display panel 100 or the target luminance of the display panel 100 so that the display quality of the display panel 100 may be increased and the power consumption may be maintained at a relatively low level.

Figure 9:
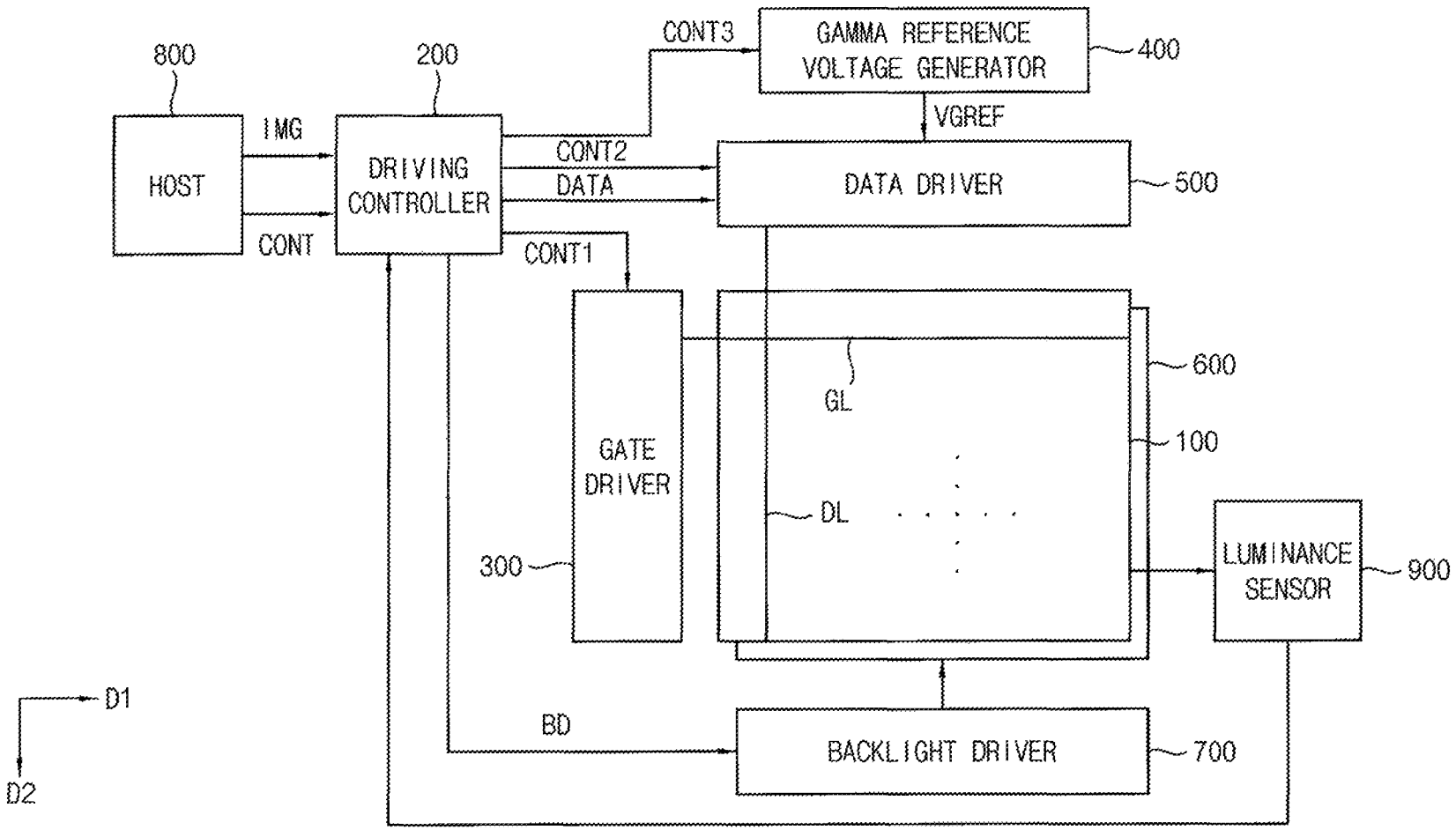
FIG. 9 is a block diagram of a display apparatus according to an exemplary embodiment of the present invention.

FIG. 9 is a block diagram of a display apparatus according to an exemplary embodiment of the present invention.

The display apparatus according to an exemplary embodiment of the present invention described below with reference to FIG. 9 may be substantially the same as the display apparatus according to an exemplar embodiment of the present invention described above with reference to FIGS. 1 to 6B except that the display apparatus further include a luminance sensor. Thus, duplicative descriptions to those described above may be omitted below with reference to FIG. 9.

Referring to FIGS. 2 to 9, the display apparatus may include the display panel 100, the display panel driver, the backlight unit 600, the backlight driver 700 and the host 800. The display panel driver may include the driving controller 200, the gate driver 300, the gamma reference voltage generator 400 and the data driver 500.

In an exemplary embodiment of the present invention, the driving controller 200 may include a luminance compensating part generating a backlight compensating signal to compensate for the difference of the luminance between the areas of the display panel 100 due to the delay GDL of the gate signal and the delay DDL of the data voltage. The delay GDL of the gate signal may be generated according to the distance between the area of the display panel 100 and the gate driver 300. The delay DDL of the data voltage may be generated according to the distance between the area of the display panel 100 and the data driver 500.

In addition, the display apparatus may include the luminance sensor 900 which senses a luminance of the image displayed on the display panel 100. The luminance sensor 900 may output the sensed luminance to the luminance compensating part.

The difference of the luminance between the areas of the display panel 100 due to the delay GDL of the gate signal and the delay DDL of the data voltage may be generated regardless of the level of the luminance. The difference of the luminance might not be perceived to the user when the luminance is relatively high. However, the difference of the luminance may be more easily perceived by the user when the luminance is relatively low.

Thus, the luminance compensating part may selectively generate the backlight compensating signal to compensate for the difference of the luminance between the areas of the display panel 100 according to the luminance sensed by the luminance sensor 900. For example, when the sensed luminance is less than a threshold luminance, the luminance compensating part may generate the backlight compensating signal to compensate the difference of the luminance between the areas of the display panel 100. The sensed luminance may be determined by averaging the sensed luminance for an entire area of the display panel 100 for a frame. Alternatively, the sensed luminance may be determined by averaging the sensed luminance for a luminance compensating area of the display panel 100 for a frame.

The operations of the luminance compensating part described in more detail above with reference to FIGS. 6A and 6B, FIGS. 7A and 7B and FIGS. 8A and 8B may be applied to an exemplary embodiment of the present invention described below with reference to FIG. 9, and thus duplicative descriptions may be omitted below.

According to an exemplary embodiment of the present invention, the intensity of the light of the backlight unit 600 corresponding to the areas of the display panel 100 may be adjusted to compensate for the difference of the luminance between the areas of the display panel 100 due to the delay GDL of the gate signal and the delay DDL, of the data voltage. In addition, the difference of the luminance may be compensated for according to the operation mode MODE of the display panel 100 or the sensed luminance of the display panel 100 so that the display quality of the display panel 100 may be increased and the power consumption may be maintained at a relatively low level.

Figure 10:
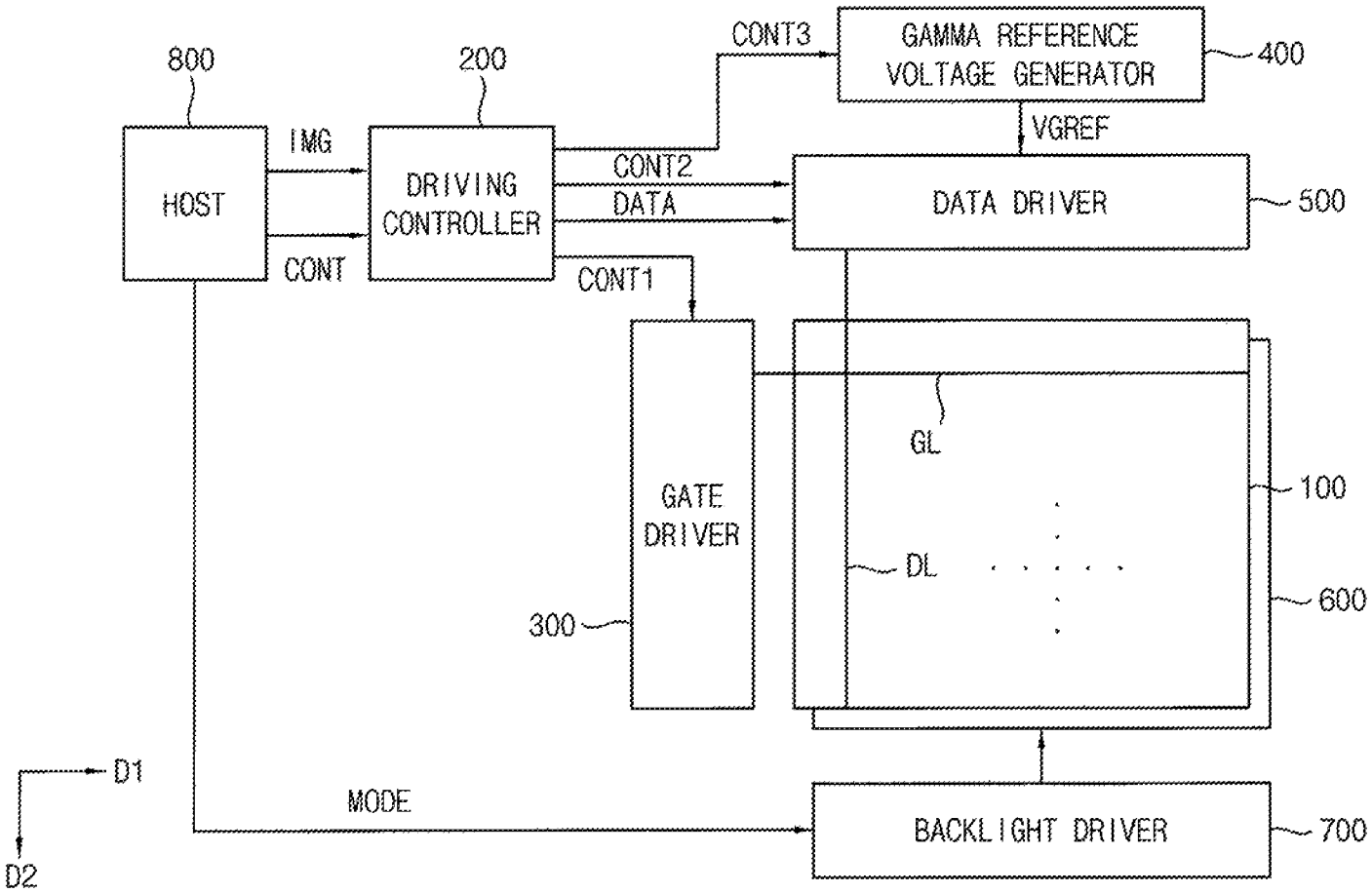
FIG. 10 is a block diagram of a display apparatus according to an exemplary embodiment of the present invention.
Figure 11:
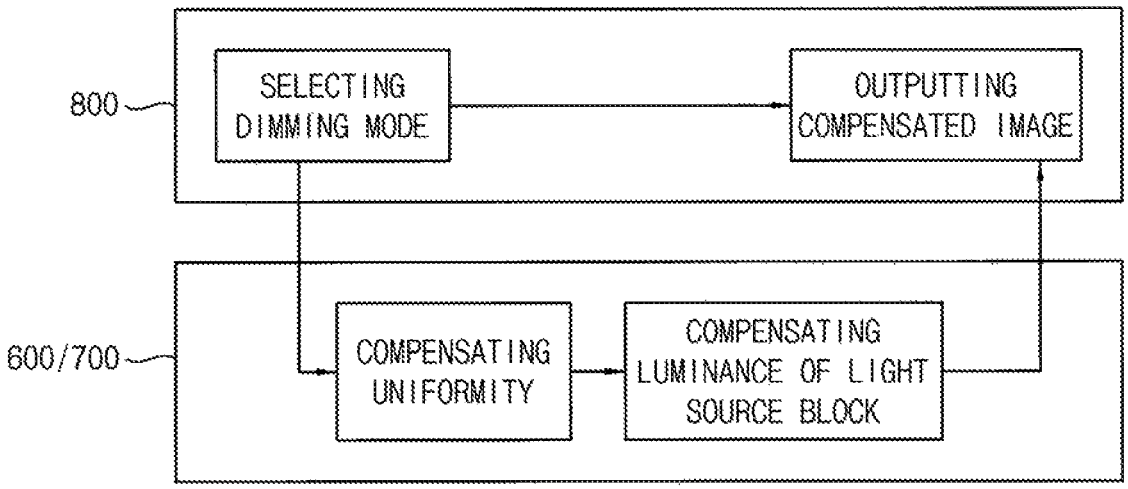
FIG. 11 is a block diagram of an operation of a host, a backlight driver and a backlight unit of FIG. 10.

FIG. 10 is a block diagram of a display apparatus according to an exemplary embodiment of the present invention. FIG. 11 is a block diagram of an operation of a host, a backlight driver and a backlight unit of FIG. 10.

The display apparatus according to an exemplary embodiment of the present invention described below with reference to FIG. 10 may be substantially the same as the display apparatus according to an exemplary embodiment of the present invention described above with reference to FIGS. 1 to 6B except that the luminance compensating part is included in the backlight driver. Thus, duplicative descriptions to those described above may be omitted below with reference to FIGS. 10 and 11. Referring to FIGS. 2 to 4 and 6A to 11, the display apparatus may include the display panel 100, the display panel driver, the backlight unit 600, the backlight driver 700 and the host 800. The display panel driver may include the driving controller 200 the gate driver 300, the gamma reference voltage generator 400 and the data driver 500.

In an exemplary embodiment of the present invention, the backlight driver 700 may include a luminance compensating part generating a backlight compensating signal to compensate for the difference of the luminance between the areas of the display panel 100 due to the delay GDL of the gate signal and the delay DDL of the data voltage. In an exemplary embodiment of the present invention, the host 800 may output the operation mode (e.g., the dimming mode) MODE to the backlight driver 700.

The backlight drive 700 may generate the backlight driving voltage based on the operation mode (e.g., the dimming mode) MODE and may output the backlight driving voltage to the backlight unit 600.

When the backlight driver 700 includes the luminance compensating part, the luminance compensating part might not operate the local dimming operation. The luminance compensating part may receive the local dimming signal from the driving controller 200. The luminance compensating part may generate the backlight driving signal by adding the local dimming signal according to the target grayscales of the display area of the input image data IMG to the luminance compensating value for compensating the difference of the luminance between the areas of the display panel 100.

The operations of the luminance compensating part described in more detail above with reference to FIGS. 6A and 6B FIGS. 7A and 7B, and FIGS. 8A and 8B may be applied to an exemplary embodiment of the present invention described below with reference to FIGS. 10 and 11, and thus duplicative descriptions may be omitted below.

According to an exemplary embodiment of the present invention, the intensity of the light of the backlight unit 600 corresponding to the areas of the display panel 100 may be adjusted to compensate for the difference of the luminance between the areas of the display panel 100 due to the delay GDL of the gate signal and the delay DDL of the data voltage. In addition, the difference of the luminance may be compensated for according to the operation mode MODE of the display panel 100 or the target luminance of the display panel 100 so that the display quality of the display panel 100 may be increased and the power consumption may be maintained at a relatively low level.

According to an exemplary embodiment of the present invention the display apparatus and the method of driving the display apparatus, the difference of the luminance between the areas of the display panel may be compensated for according to the operation mode of the display panel or the target luminance of the display panel so that the display quality of the display panel may be increased.

While the present invention has been shown and described with reference to the exemplary embodiments thereof, it will be apparent to those of ordinary skill in the art that various changes in form and detail may be made thereto without departing from the spirit and scope of the present invention.

What is claimed is:

1. A display apparatus comprising:

a plurality of adjacent display panels configured to collectively display an image, each display panel including at least two drivers and a plurality of display areas, each display are having a plurality of pixels;

a backlight panel including a plurality of light source blocks, each of the display areas overlapping a respective light source block, the backlight panel configured to provide light to the display panels; and a panel driver connected to the display panels and the backlight panel, wherein the panel driver is configured to generate a backlight compensating signal having different compensating values for each of the plurality of light source blocks, wherein different compensating values within each display panel compensate intra-panel uniformity of display areas based on different respective distances from each of the at least two drivers of each display panel to each of the plurality of display areas of the display panel, respectively, wherein the at least two drivers of each display panel comprise a gate driver disposed in a first location relative to the display panel and configured to output a gate signal to the display panel, and a data driver disposed in a second location relative to the display panel different from the first location and configured to output a data signal to the display panel, wherein the plurality of display areas of each display panel includes at least a first display area disposed in a first portion of the display panel and a second display area disposed in a second portion of the display panel, wherein a first display area of a second display panel of the plurality of adjacent display panels is disposed adjacent to a second display area of a first display panel of the plurality of adjacent display panels, wherein the first display area of the second display panel overlaps a first light source block of the backlight panel, and the second display area of the first display panel overlaps a second light source block of the backlight panel, wherein different compensating values between the plurality of adjacent display panels compensate inter-panel luminance of light source blocks for the first light source block and the second light source block based on at least one of different measured luminance or different respective distance from the panel driver to the first display area of the second display panel and the second display area of the first display panel, respectively, wherein the panel driver applies the backlight compensating signal based on the different compensating values within and between the display panels to the first light source block or the second light source block based on a ratio of a luminance of the first light source block to a luminance of the second light source block.

2. The display apparatus of claim 1, wherein the driving controller receives an operation mode of the display panel, wherein the operation mode includes a day mode and a night mode, wherein the driving controller generates the backlight compensating signal when the operation mode is the night mode.

3. The display apparatus of claim 1, wherein the driving controller generates the backlight compensating signal when a target luminance of the image displayed on the display panel is less than a threshold luminance.

4. The display apparatus of claim 1, further comprising a luminance sensor configured to sense a luminance of the image displayed on the display panel, wherein the driving controller generates the backlight compensating signal when the sensed luminance is less than a threshold luminance.

5. The display apparatus of claim 1, wherein when a luminance of the central light source block is LA and a luminance of the corner light source block is LB, the driving controller applies the backlight compensating signal to the corner light source block according to LA/LB.

6. The display apparatus of claim 1, wherein when a luminance of the central light source block is LA and a luminance of the corner light source block is LB, the driving controller applies the backlight compensating signal to the central light source block according to LB/LA.

7. The display apparatus of claim 1, further comprising a driving controller configured to receive input image data and an input control signal and output a control signal to the panel driver, wherein the driving controller includes the driving controller.

8. The display apparatus of claim 7, wherein the driving controller applies a local dimming signal according to target grayscales of the input image data for the display areas to the compensating values according to the distance between the panel driver and the display areas of the display panel to generate a backlight driving signal.

9. The display apparatus of claim 1, further comprising:

a backlight driver connected to the backlight panel and outputting a backlight driving signal to the backlight panel, wherein the backlight driver is connected to the driving controller.

10. The display apparatus of claim 1, further comprising a driving controller disposed between the panel driver and the plurality of adjacent display panels, wherein the driving controller is configured to generate the backlight compensating signal to compensate for a difference in luminance between respective areas of each display panel due to respective delays of the gate signal and respective delays of the data signal to each respective area of each display panel, wherein the first light source block is overlapped with the first display area in a central portion of the display panel and the second light source block is overlapped with the second display area in a corner portion of the display panel relatively farther than the central portion from at least one of the gate driver or the data driver.

11. The display apparatus of claim 10, wherein when a luminance of the central light source block is LA and a luminance of the first corner adjacent light source block is LC, the driving controller applies the backlight compensating signal to the first corner adjacent light source block according to LA/LC.

12. The display apparatus of claim 10, wherein when a luminance of the corner light source block is LB and a luminance of the first corner adjacent light source block is LC, the driving controller applies the backlight compensating signal to the first corner adjacent light source block according to LB/LC.

13. The display apparatus of claim 1, wherein each respective delay of the gate signal is determined according to a first respective distance to each respective one of the plurality of display areas from the gate driver, and each respective delay of the data signal is determined according to a second respective distance to each respective one of the plurality of display areas from the data driver, wherein the first light source block is adjacent to the first display area in a central edge portion of the display panel and the second light source block is adjacent to the second display area in a corner edge portion of the display panel relatively farther than the central edge portion from at least one of the gate driver or the data driver.

14. The display apparatus of claim 13, wherein when a luminance of the central edge light source block is LA and a luminance of the corner edge light source block is LB, the driving controller applies the backlight compensating signal to the corner edge light source block based on LA/LB.

15. The display apparatus of claim 14, wherein the display panel further includes a first corner adjacent display area adjacent to the corner edge display area, wherein the backlight panel further includes a corner adjacent edge light source block adjacent to the first corner adjacent display area, and wherein when a luminance of the central edge light source block is LA and a luminance of the corner adjacent edge light source block is LC, the luminance compensating applies the backlight compensating signal to the corner adjacent edge light source block according to LA/LC.

16. The display apparatus of claim 13, wherein the driving controller receives an operation mode of the display panel, wherein the operation mode includes a day mode and a night mode, wherein the driving controller generates the backlight compensating signal when the operation mode is the night mode.

17. The display apparatus of claim 13, wherein the driving controller generates the backlight compensating signal when a target luminance of the image displayed on the display panel is less than a threshold luminance.

18. The display apparatus of claim 13, further comprising:

a luminance sensor configured to sense a luminance of the image displayed on the display panel, wherein the driving controller generates the backlight compensating signal when the sensed luminance is less than a threshold luminance.

19. The display apparatus of claim 13, wherein:

the driving controller is configured to receive input image data and an input control signal and output a control signal to the panel driver.

20. The display apparatus of claim 13, the panel driver further comprising:

at least one display panel driver connected to the plurality of adjacent display panels; and a backlight driver connected to the backlight panel and outputting a backlight driving signal responsive to the backlight compensating signal to the backlight panel.

* * * * *